United States Patent [19]

Morse et al.

[11] Patent Number: 4,734,150

[45] Date of Patent: Mar. 29, 1988

[54] SHOE SUBSTRATE REINFORCING MACHINE

[75] Inventors: Albert I. Morse; Douglas H. Crowell, both of Beverly, Mass.

[73] Assignee: DVSG Patentverwaltungs GmbH, Frankfurt, Fed. Rep. of Germany

[21] Appl. No.: 919,285

[22] Filed: Oct. 15, 1986

[51] Int. Cl.[4] ..... B23Q 3/00

[52] U.S. Cl. ..... 156/578; 269/303; 269/316

[58] Field of Search ..... 269/303–305, 269/307, 316, 54.5; 156/578

[56] References Cited

U.S. PATENT DOCUMENTS

| | | | |
|---|---|---|---|
| 3,608,886 | 9/1971 | Greene | 269/307 X |
| 3,860,229 | 1/1975 | Anderson | 269/316 |
| 4,519,867 | 5/1985 | Rubey | 156/556 X |

*Primary Examiner*—David Simmons

*Attorney, Agent, or Firm*—Owen J. Meegan; Aubrey C. Brine

[57] ABSTRACT

The present invention relates to machines which deposit powder in a selected configuration, fuse the powder into a laminate and adhere the fused laminate to a shoe substrate to reinforce the substrate, and more particularly, to instrumentalities to assist the machine operator to properly locate the shoe substrate on the machine.

6 Claims, 6 Drawing Figures

SHOE SUBSTRATE REINFORCING MACHINE

The present invention relates to machines which deposit powder in a selected configuration, fuse the powder into a laminate and adhere the fused laminate to a shoe substrate to reinforce the substrate, and more particularly, to instrumentalities to assist the machine operator to properly locate the shoe substrate on the machine.

In such machines, it is important to accurately locate the substrate so that the fused laminate will be adhered symmetrically at the proper location. Alignment mechanisms such as are disclosed in U.S. Pat. No. 4,607,741 have been utilized for this purpose. Such mechanisms are set for a specific shoe substrate and may be adjusted for different substrates.

It is an object of the present invention to provide an improved substrate alignment structure.

Other objects and advantages of the present invention will become apparent from the following portion of this specification and from the accompanying drawings which illustrate in accordance with the mandate of the patent statutes a presently preferred embodiment incorporating the principles of the present invention.

Referring to the drawings.

Figure 1:
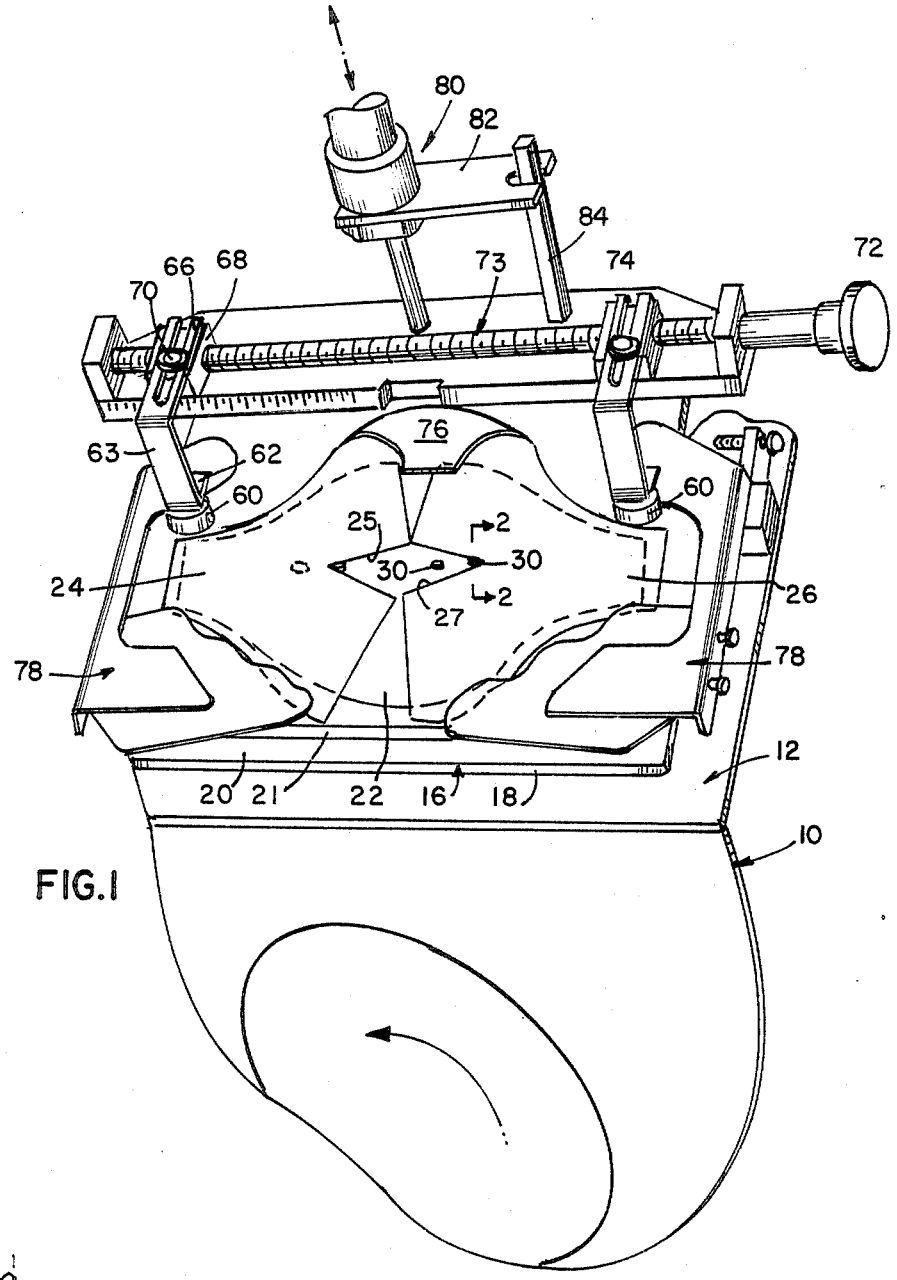
FIG. 1 is a top oblique view of a portion of a rotatable transfer cube of a machine which will deposit powder, fuse the powder into a laminate and adhere the laminate to a shoe substrate.

In state of the art machines which deposit powder in a selected configuration, fuse the powder into a laminate and adhere the fused laminate to a shoe substrate to reinforce the substrate, a rotatable transfer cube 10 having four faces 12 (only the top face shown) sequentially indexes each face from the top horizontal clamp-/unclamp position, counterclockwise through a vertical ready position to a lower horizontal substrate adhering position where the face is pressed downwardly against the fused laminate and then back through the second vertical position to the clamp/unclamp position.

Each transfer cube face 12 has a mounting plate 16 which includes a metallic base 18, a pad of resilient material 20 which is secured to the metallic base 18, a thin pair of firmer resilient material 21 which is secured to the lower pad 20, and a thin layer of Teflon 22 which is secured to the upper pad 21 and which facilitates placement and removal of a pair of shoe substrates 24, 26. The disclosed machine is intended to operate on two families of shoe counters. One of these families 24 has a small back seam notch 25 while the other 26 has a large back seam notch 27. While one of each family is shown placed on the mounting plate 16, for purposes of illustration, identical parts would normally be processed.

Figure 2:
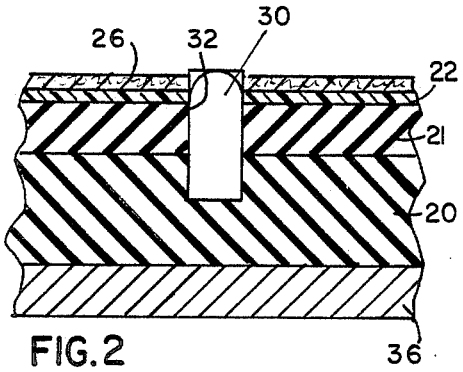
FIG. 2 is a view taken along lines 2—2 of FIG. 1 illustrating one of locating pin assemblies.

Proper placement of these substrates is essential if the fused laminate is to be adhered at the intended location. To this end, four locating pins 30 are used. Each pin (FIG. 2) is located within a vertical hole 32 which is drilled through the Teflon layer 22, the top pad of resilient material 21, and partially into the lower resilient pad 20. The depth of this hole 32 is selected so that the locating pin 30 will project above the Teflon layer 22 by a distance substantially equal to the thickness of the shoe substrate 26. The outside pair of locating pins 30 are positioned to locate the larger back seam notch 27 and the inside pair of locating pins 30 are positioned to locate the smaller back seam notch 25. When a substrate with a small back seam notch is located, the substrate will overlie the locating pin which would locate the large back seam notch of the other family of substrates. The resilience of the lower pad 20 material below that locating pin 30 permits the pin to be pushed downwardly to the level of the Teflon surface during the pressing of the substrate onto the fused laminate. The fused laminate is so located that it will not be located above the depressed locating pin.

Figure 3:
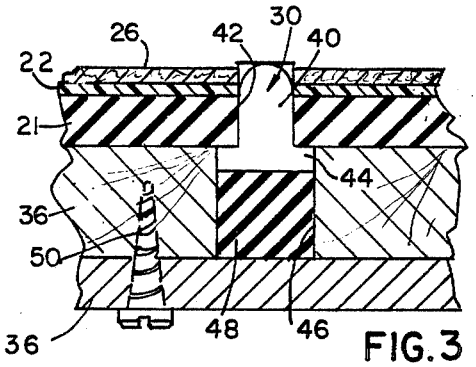
FIG. 3 is a view similar to that of FIG. 2 illustrating an alternate locating pin assembly embodiment.
Figure 5:
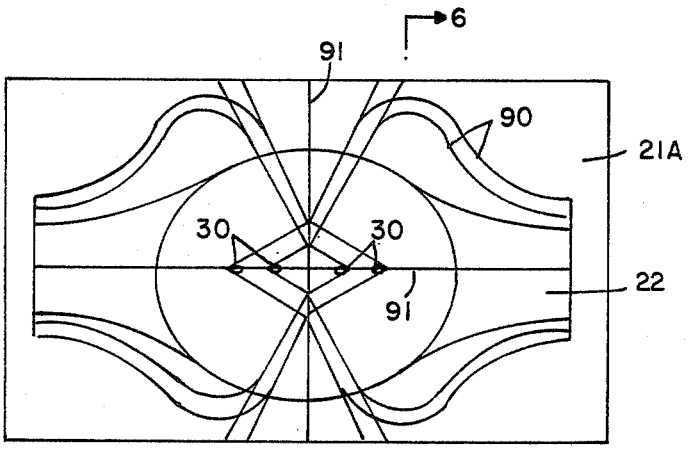
FIG. 5 is a view similar to that of FIG. 1 showing the top surface of the mounting plate with the shoe substrates removed.
Figure 6:
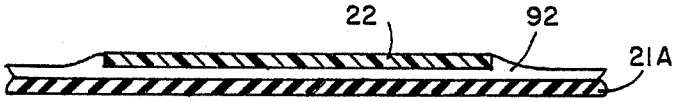
FIG. 6 is a view taken at 6—6 of FIG. 5.

If desired, the mounting plate (FIG. 3) may include the surface layer of Teflon, 22, the upper pad of firm resilient material 21, a base pad 36 of wood and a metallic base 18. The locator 30 illustrated in FIG. 3 has a post portion 40 which extends through a suitable hole 42 in the Teflon 22 and resilient pad 21 and an enlarged head portion 44 which is received within a hole 46 defined in the base plate 36 and which is normally maintained against the resilient pad by a rubber plug 48 captured by the metallic base 18 which is releasably fastened to the base plate 36 by fasteners 50. The strength of the compressed spring 48 is selected to permit the depression of the pin as desired.

Figure 4:
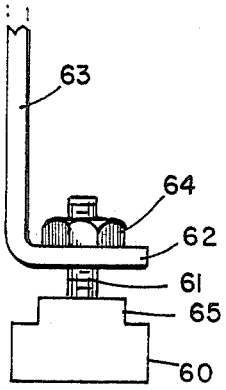
FIG. 4 is a side elevational view of one of the rear locating guides of the machine illustrated in FIG. 1.

A second locating point for each substrate is provided by locating guides 60 which will abut against an edge of each counter. These guides 60 (FIG. 4) have a threaded vertical shaft 61 which is threadedly received by a threaded hole in the bottom portion 62 of the locating brackets 63 and are retained in position by locknuts 64. The guides have opposed flats 65 so that a turning tool can be used to adjust their height. The locating brackets 63 are slidably displaceable in slots 66 defined in opposing translation nuts 68 to adjust the front to back location of the locating guides. Fasteners 70 secure the brackets 63 to these translation nuts 68. These brackets are also adjustable conjointly side to side by rotating the knurled knob 72 of the translation screw 73 which is mounted on a support plate 74. Once the pair of substrates is located and clamped in position by the heel clamp 76 and the side clamps 78, the entire locating assembly is elevated away from the mounting plate 16 by raising a piston assembly 80. To assure the precise orientation of the support plate 74, a slotted bracket 82 is fixed to the piston assembly 80 and is keyed to a post 84 which extends upwardly from the support plate 74.

To further assist the machine operator, reference lines 90 which correspond to the shape of counters to be positioned on the mounting plate or reference lines 91 which divide the mounting plate into quadrants are defined on the top surface of a thin sheet 21A of light grey silicone rubber which is sold under the trademark "Chorlastic". This surface provides excellent wear characteristics and a good background for the reference lines. This thickness of the Teflon layer 22 is made small enough so that these reference lines 90, 91 may be seen through the Teflon. On the portion of the thin sheet 21A which is not covered with Teflon, a layer of clear adhesive sealant 92, which may be silicon rubber, is applied to form a protective layer for the exposed reference lines.

What is claimed is:

1. A machine for depositing powder in a selected configuration, fusing the powder into a laminate and pressing the fused laminate against a shoe substrate, comprising:

means for supporting a family of shoe substrates to which a fused laminate is to be adhered, each said shoe substrate having a selectively configured shape which is to be accurately positioned on said supporting means to properly receive the substrate, said supporting means including;

a layer of surface material, onto which the shoe substrate is placed;

an underlying layer of resilient material disposed beneath said layer of surface material;

at least two locater pins, each extending through an opening formed in said layer of surface material; and a pad of selectively compressible material supporting each said pin whereby said locater pins are pushed downwardly to a position flush with said layer of surface material when the fused laminate is pressed onto the shoe substrate.

2. A machine as set forth in claim 1 wherein said pad of selectively compressible material supporting each said pin comprises a portion of said underlying layer of resilient material.

3. A machine as set forth in claim 2 which further includes reference lines defined on said layer of resilient material to assist an operator in proper placement of a shoe substrate and the thickness of said layer of surface material is selected to be thin enough such that said reference lines can be seen therethrough.

4. A machine as set forth in claim 3 wherein said layer of surface material is formed of a polytetrafluoroethylene material.

5. A machine as set forth in claim 3 wherein said reference lines extend beyond said layer of surface material, said means for supporting a family of shoe substrates further comprising a transparent permanent protective layer secured to the upper surface of said layer of resilient material to cover the reference lines which extend beyond said layer of surface material.

6. A machine as set forth in claim 1 wherein said pad of selectively compressible material supporting each said pin comprises a cylindrical plug of compressible material.

* * * * *